United States Patent [19]

Kusmer

[11] 4,408,262

[45] Oct. 4, 1983

[54] PLASTER FRAME FOR RECESSED LIGHTING

[75] Inventor: Raymond J. Kusmer, Elgin, Ill.

[73] Assignee: McGraw-Edison Company, Rolling Meadows, Ill.

[21] Appl. No.: 384,025

[22] Filed: Jun. 1, 1982

[51] Int. Cl.[3] ..... F21S 1/02

[52] U.S. Cl. ..... 362/147; 362/296; 362/306; 362/364; 362/365; 362/368; 362/370; 362/371; 362/396; 362/406; 362/418; 362/430

[58] Field of Search ..... 362/147, 306, 296, 365, 362/368, 370, 371, 396, 406, 364, 418, 430

[56] References Cited

U.S. PATENT DOCUMENTS

| | | | |
|---|---|---|---|
| 2,716,185 | 8/1955 | Burliuk et al. | 362/366 |
| 4,188,656 | 2/1980 | Howard | 362/365 |
| 4,327,403 | 4/1982 | Capostagno | 362/306 |
| 4,336,575 | 6/1982 | Gilman | 362/147 |

*Primary Examiner*—Stephen J. Lechert, Jr.
*Assistant Examiner*—Howard J. Locker
*Attorney, Agent, or Firm*—Charles W. MacKinnon; Ronald J. LaPorte; Jon Carl Gealow

[57] ABSTRACT

A plaster frame for mounting a lighting fixture in recessed fashion in a ceiling comprises a main body portion including a rectangular, planar member defining an aperture therein, the aperture being similarly dimensioned to the ceiling aperture in which the lighting fixture is to be mounted. Hanger bar brackets are integrally formed with the planar member at breakaway junctions along opposite, first sides of the planar member. The hanger bar brackets are adapted to receive hanger bars for mounting the plaster frame between spaced joists supporting the ceiling. Each hanger bar bracket is removable from the planar member by bending at the breakaway junctions. The hanger bar brackets are reattachable to the planar member along opposite, second sides thereof by means of bendable, spaced tabs formed on the brackets receivable in similarly spaced apertures defined in the planar member. The ability to relocate the hanger bar brackets permits the plaster frame to be oriented in two ways between the spaced ceiling joists. Complete removal of the hanger bar brackets permits insertion of the plaster frame through an aperture defined in an existing ceiling to provide support for a lighting fixture on the interior surface of the ceiling.

9 Claims, 9 Drawing Figures

FIG. 5
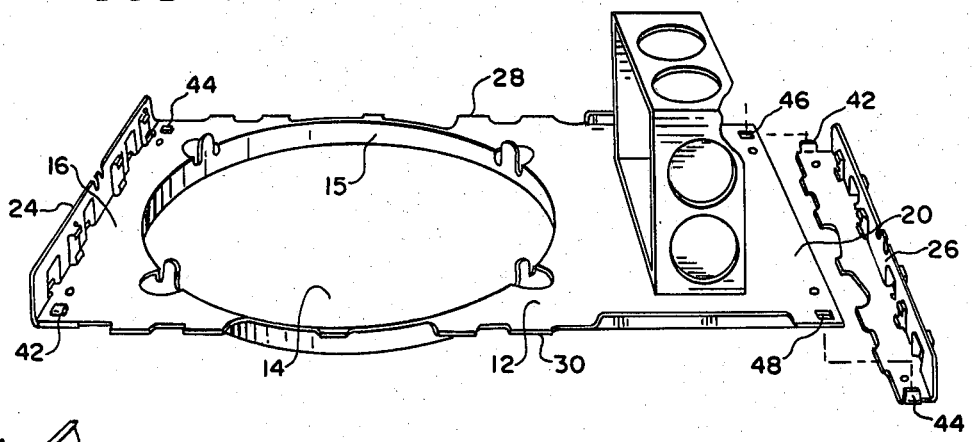
FIG. 6
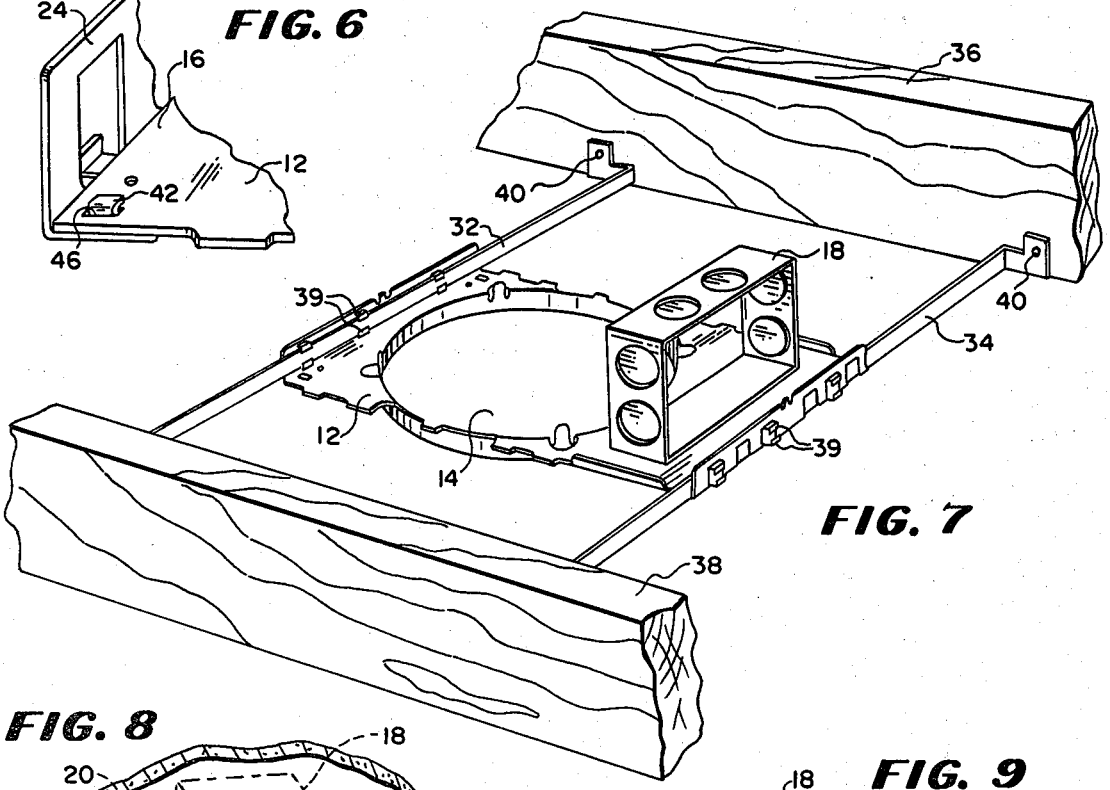
FIG. 7
FIG. 8
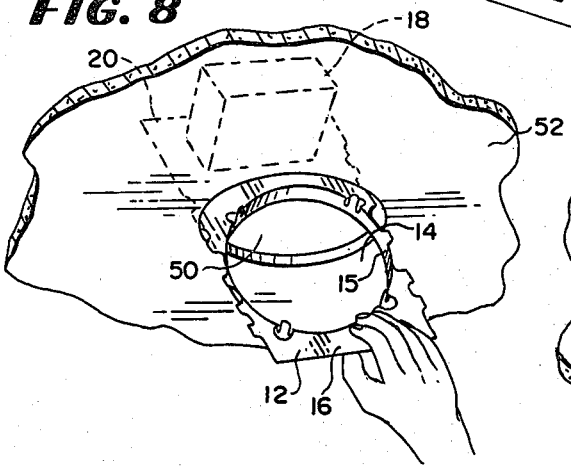
FIG. 9
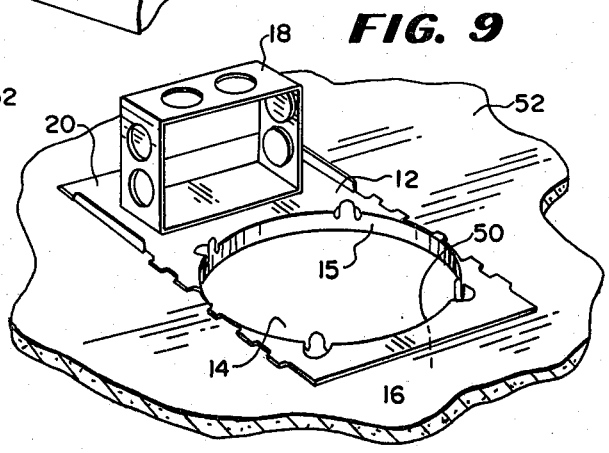

PLASTER FRAME FOR RECESSED LIGHTING

BACKGROUND OF THE INVENTION

This invention relates generally to apparatus for use in mounting recessed lighting fixtures in ceilings or the like support surfaces and, more particularly, to plaster frames employed for such purpose.

Conventionally, when recessed lighting fixtures are mounted in ceilings of houses, office buildings, or the like structures, what is commonly known as a "plaster frame" is used to provide support to the lighting fixture housing. A plaster frame is generally a metal member mounted on hanger bars between the joists of the structure supporting the ceiling. The plaster frame generally comprises a main body portion including a rectangular planar member defining an aperture therein surrounded by a depending flange or rim for receipt in a similarly shaped aperture of slightly larger dimension formed in the ceiling surface in which the lighting fixture is to be mounted. An electrical junction box for electrically wiring the fixture is usually also included as a part of the plaster frame.

Oftentimes a plaster frame will also be employed when it is desired to add a recessed fixture in an existing ceiling structure.

Commonly, brackets for receiving the hanger bars on which the plaster frame is mounted between the ceiling joists, are provided at opposite ends of the rectangular planar member of the plaster frame. If the spacing between joists to be used to support a particular plaster frame is such that the plaster frame is improperly dimensioned or if the plaster frame cannot be used because the direction of the run of electrical conduit behind the ceiling is improper, or if there are other difficulties encountered with a particular plaster frame, either another type of plaster frame will be required or a reconstructure of the available plaster frame must be made on the job site so that the plaster frame is usable. To be able to have available several varieties of plaster frames to accommodate various installation requirements, there exists a need for lighting fixture manufacturers to produce, and lighting fixture dealers to maintain in inventory, a number of different types of plaster frames. On the other hand, if a plaster frame is to be reconstructed on the job site, additional time may be required for a fixture installer to modify the plaster frame, causing, in many cases, the cost of the installation to be increased.

In the case wherein a plaster frame is employed to mount a recessed fixture in an existing ceiling, it has sometimes been difficult to mount the plaster frame "behind" the ceiling without creating an opening in the ceiling greater in dimension than the aperture needed for insertion of the lighting fixture, thus requiring repairs to the ceiling subsequent to the mounting of the fixture. To avoid the latter, in many installations of this type, specially designed, more costly lighting fixtures are employed.

SUMMARY OF THE INVENTION

Accordingly, it is a primary object of the present invention to provide a new and improved plaster frame for installing recessed lighting fixtures in ceilings, which plaster frame overcomes the drawbacks of prior art plaster frames discussed heretofore.

It is another object of the present invention to provide a new and improved plaster frame for use in installing recessed lighting fixtures, which plaster frame is relatively inexpensive to manufacture and is effective for mounting recessed lighting fixtures in newly constructed sites as well as in existing structures.

Briefly, a preferred embodiment of the plaster frame according to the invention comprises a main body portion including a rectangularly shaped planar member defining an aperture therein, the size of the aperture being just slightly smaller than a similarly shaped aperture defined in a ceiling wherein a recessed lighting fixture is to be mounted. A depending flange formed with the main body portion surrounds the aperture of the plaster frame for receipt in the ceiling aperture. An electrical junction box is affixed to the planar member of the plaster frame, adjacent the aperture defined therein. Hanger bar brackets are formed integrally with the planar member on opposite long sides thereof, adjacent the aperture defined therein. The junctions between the hanger bar brackets and planar member are of the breakaway type. Thus, by moving the hanger bar brackets in a back and forth manner with respect to the planar member, the brackets will become detached therefrom. No tools are necessary to accomplish the latter.

Spaced tabs formed on the hanger bar brackets are receivable in similarly spaced apertures located along the short sides of the rectangular planar member. Once received therein, the tabs are bendable to secure the hanger bar brackets to the planar member at the new locations.

The ability to alter the locations of the hanger bar brackets on the planar member thus permits the plaster frame to be oriented in one of two ways between ceiling joists on which the plaster frame is to be mounted; i.e., with the planar member extending lengthwise or widthwise between the ceiling joists.

Furthermore, in the case of an existing ceiling, the hanger bar brackets may be removed completely from the planar member, thus reducing the width of the plaster frame to slightly less than that of the dimension of the aperture defined in the ceiling, thereby permitting the plaster frame to pass through the last-mentioned aperture used to mount the plaster frame on the opposite surface of the ceiling.

DESCRIPTION OF THE DRAWINGS

In the drawings:

FIG. 5 is an isometric view of the plaster frame according to the invention, illustrating the reattachment of the hanger bar brackets thereof on the short, opposite sides of the main body portion of the plaster frame subsequent to the removal of the hanger bar brackets from the opposite, long sides of the main body portion;

FIG. 6 is an enlarged, fragmentary, perspective view of the plaster frame of FIG. 5, illustrating the reattachment of the hanger bar brackets to the main body portion;

FIG. 7 is a perspective view of the plaster frame of FIG. 5 shown mounted between spaced ceiling joists in a second orientation;

FIG. 8 is a perspective view of an existing ceiling defining an aperture for mounting a lighting fixture, into which a plaster frame from which the hanger bar brackets have been detached, according to the invention, is being inserted; and FIG. 9 is a perspective view of the ceiling of FIG. 8, subsequent to the mounting of the plaster frame on the opposite, interior ceiling surface.

DETAILED DESCRIPTION OF THE DRAWINGS

Figure 1:
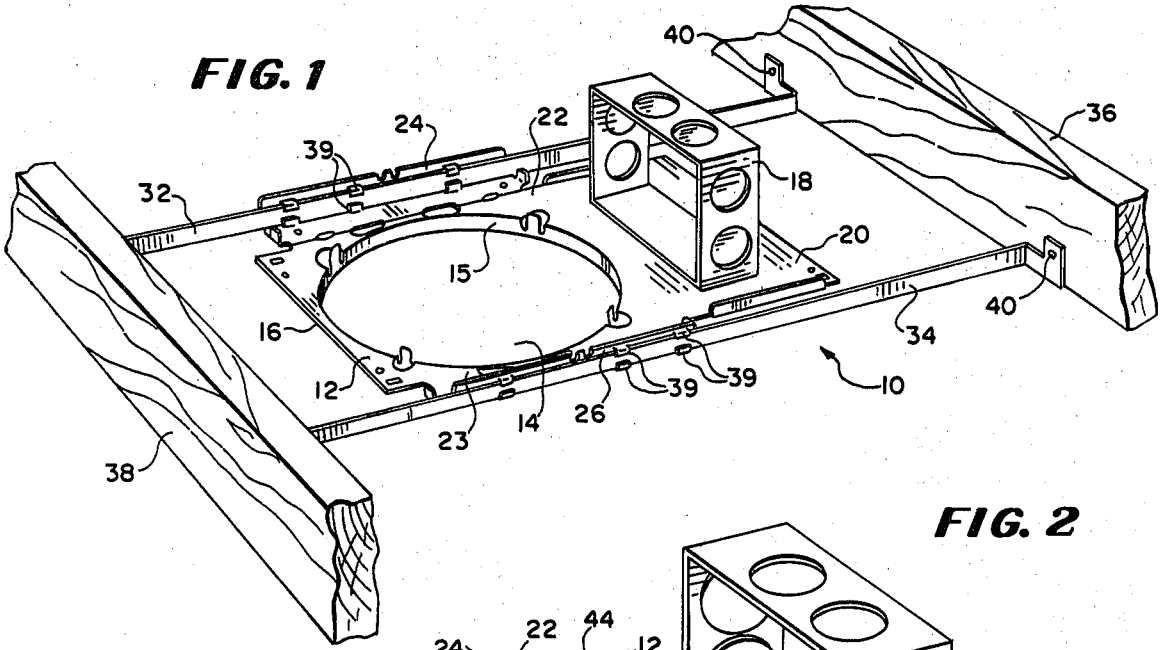
FIG. 1 is a perspective view of the plaster frame according to the invention shown mounted between spaced ceiling joists in a first orientation.
Figure 2:
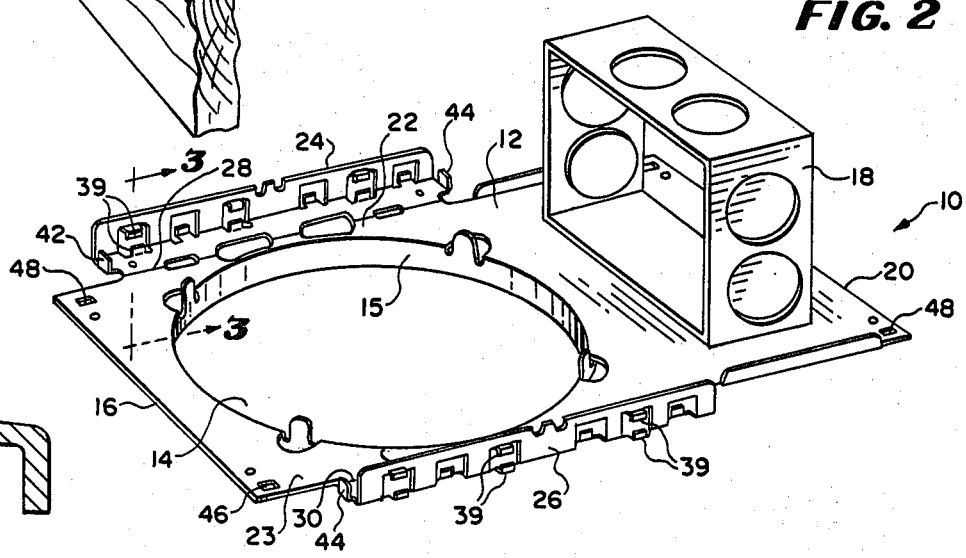
FIG. 2 is an enlarged perspective view of the plaster frame of FIG. 1.

Referring now to the drawings in greater detail wherein like numerals have been employed throughout the various views to designate similar components, a preferred embodiment 10 of a plaster frame according to the invention is illustrated in FIGS. 1 and 2.

Plaster frame 10 is fabricated preferably of metal and comprises a main body portion including a planar member 12, having a rectangular shape. An aperture 14, shown as being circular in shape in the plaster frame embodiment 10, to accommodate a similarly shaped lighting fixture to be recess mounted, is defined in member 12 near a first short side 16 thereof. A depending flange or rim 15 is formed about aperture 14 for extension into an aperture, such as, for example, 50 (FIGS. 8 and 9) of similar shape as aperture 14, defined in a ceiling in which the lighting fixture will be mounted.

An electrical junction box 18, having a cross dimension less than that of the width of planar member 12, is affixed to member 12 near opposite short side 20 thereof.

Figure 3:
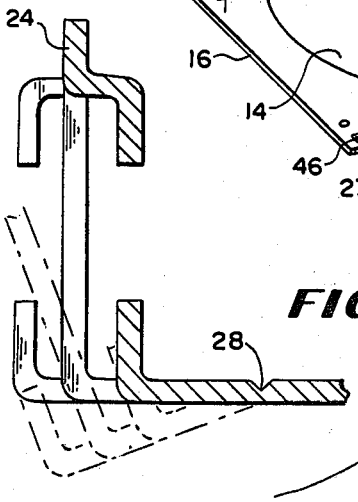
FIG. 3 is a sectional view of the plaster frame of FIG. 2, taken along the line 3—3 thereof.

Formed integrally with planar member 12 on opposite long sides 22, 23 thereof, adjacent aperture 14, are hanger bar brackets 24, 26, respectively. Hanger bar brackets 24, 26 are joined to member 12 along breakaway junctions 28, 30, respectively. Breakaway junction 28 is best illustrated in FIG. 3 of the drawings.

Junctions 28, 30 are of sufficient strength to support plaster frame 10 and a lighting fixture (not shown) from hanger bars, such as, 32, 34, which are receivable in brackets 24, 26, respectively, as shown in FIG. 1. Junctions 28, 30, are likewise constructed to permit the relatively easy detachment of the brackets from planar member 12, merely by bending the bracket in a back and forth motion with respect to the planar member, as illustrated in FIG. 3 in dotted lines and in FIG. 4 of the drawings. No special tools are required for detaching brackets 24, 26 from member 12.

Plaster frame 10 may be oriented in two ways between ceiling support joists 36, 38, (see FIGS. 1 and 7), to accommodate a variety of difficulties which may be encountered, such as, for example, limited space permitted within the area above the ceiling surface, too little distance between joists 36, 38, and/or the direction in which electrical conduits run above the ceiling surface.

Orientation of the plaster frame as shown in FIG. 1; i.e., lengthwise between joists 36, 38, requires no alteration of the plaster frame, rather only the insertion of hanger bars 32, 34 into the hanger bar brackets. Hanger bar brackets include conventional finger portions 39 facing in opposite directions between which the hanger bars are slidably received. The hanger bars may be received in the bracket finger portions on either side of the bracket as desired (see FIG. 1). The hanger bars are fastened in a conventional manner, by nails, screws, or other suitable fastener 40, to joists 36, 38 to support the plaster frame in position above the ceiling surface. The plaster frame is positioned with rim 15 surrounding aperture 14 of the planar member 12 being received in a lighting fixture receiving aperture such as, for example, aperture 50 in ceiling 52 (FIGS. 8 and 9) to locate and position the plaster frame with respect thereto.

Figure 4:
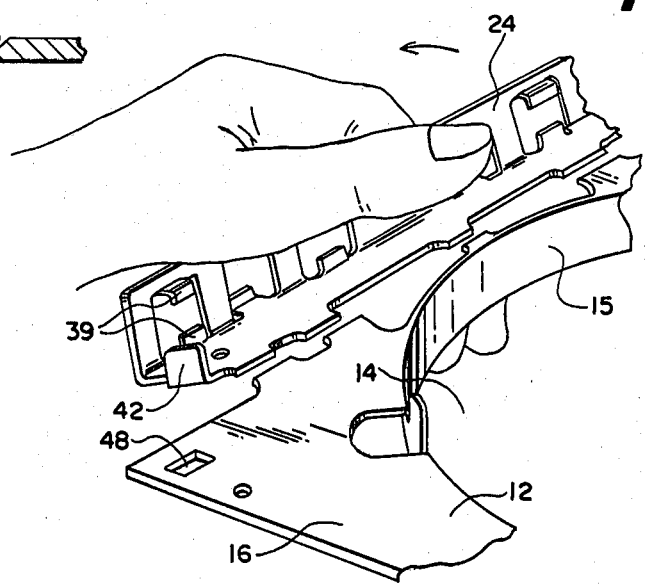
FIG. 4 is a fragmentary, enlarged, perspective view of the plaster frame according to the invention, illustrating the detachment of one of the breakaway hanger bar brackets thereof.

If it is desired to use the plaster frame in a second orientation; i.e., with the plaster frame extending widthwise between joists 36, 38, hanger bar brackets 24, 26 are broken away from planar member 12 as shown in FIGS. 3 and 4, and repositioned on planar member 12 along opposite, short sides, 16, 20, respectively, thereof.

Each of the hanger bar brackets 24, 26, includes a pair of upwardly extending tabs 42, 44, respectively. The tabs are located at opposite ends of the hanger bar brackets and are spaced predeterminedly from each other along the bracket.

Apertures 46, 48 defined in member 12 along short sides 16, 20, respectively, are provided to received tabs 42, 44, respectively, for reattaching brackets 24, 26, to the planar member. Apertures 46, 48 are spaced from each other a distance equal to the spacing between tabs 42, 44. An illustration of the reattachment of brackets 24, 26 to planar member 12 along the short sides 16, 20, thereof, is provided if FIG. 5 of the drawings.

Once tabs 42, 44, are received in apertures 46, 48, respectively, the tabs are bent over as shown in FIG. 6 to secure the brackets to planar member 12.

Mounting plaster frame 10 between joists 36, 38, is accomplished in the same manner as described heretofore. Hanger bars 32, 34 are inserted through the finger portions of hanger bar brackets 24, 26 in a conventional manner and the ends of the hanger bars are thereafter fastened to spaced joists 36, 38 by nails, screws or other suitable fasteners. Rim 15 of planar member 12 likewise is received in a similarly shaped aperture defined in the ceiling to accommodate a lighting fixture in the well-known manner.

In the case wherein it is desired to use plaster frame 10 in an existing ceiling structure, detachment of the hanger bar brackets is accomplished as described heretofore; i.e. as shown in FIGS. 3 and 4. With the hanger bar brackets completely removed from planar member 12, the width of the plaster frame is essentially defined by the cross dimension, in this case the diameter of rim 15, surrounding aperture 14 defined in planar member 12. With the diameter of rim 15 being slightly shorter than the diameter of aperture 50 defined in ceiling 52 (FIGS. 8 and 9) in which a lighting fixture is to be mounted, it is possible to pass the entire plaster frame through aperture 50 as shown in FIG. 8. Once the plaster frame has been received in the interior of the ceiling 52, the plaster frame is guided into position with rim 15 extending downwardly into aperture 50, thereby to position the plaster frame on the opposite ceiling surface. In this case, no hanger bar support is provided to the plaster frame, however, plaster frame 10 does provide support and a means for wiring a recessed lighting fixture mounted in aperture 50 of ceiling 52.

While a particular embodiment of the invention has been shown and described, it should be understood that the invention is not limited thereto since many modifications may be made. It is therefore contemplated to cover by the present application any and all such modifications as fall within the true spirit and scope of the appended claims.

I claim:

1. A plaster frame for mounting a lighting fixture in recessed fashion in a predeterminedly dimensioned aperture defined in a ceiling, said ceiling being supported by predeterminedly spaced ceiling joists, said plaster frame including in combination:

a main body portion including a planar member, said planar member defining an aperture therein dimensioned similarly to said aperture defined in said ceiling;

first and second hanger bar brackets integrally formed with said planar member along first and second breakaway junctions, respectively, generally located along first and second sides of said planar member, respectively, said hanger bar brackets being adapted for receipt of hanger bars for mounting said plaster frame in a first orientation between said ceiling joists with said aperture defined in said planar member being aligned with said ceiling aperture, said hanger bar brackets being detachable from said planar member at said breakaway junctions;

each said hanger bar bracket including means for reattaching said hanger bar bracket to said planar member at third and fourth sides thereon, respectively, said third and fourth sides being generally perpendicular to said first and second sides, for mounting said plaster frame between said ceiling joists in a second orientation different from said first orientation.

2. A plaster frame as claimed in claim 1 wherein said planar member is rectangularly shaped, having first and second opposite long sides and first and second opposite short sides, said first and second hanger bar brackets being integrally formed with said planar member at said breakaway junctions along said first and second opposite long sides of said planar member, respectively, and wherein said hanger bar brackets are reattachable to said planar member along said first and second short sides, respectively, of said planar member.

3. A plaster frame as claimed in claims 1 or 2, wherein said planar member includes aperture means defined at said third and fourth sides, respectively, and wherein said hanger bar brackets each include tab means receivable in said aperture means, for securing said hanger bar brackets to said planar member at said third and fourth sides, respectively.

4. A plaster frame as claimed in claim 3 wherein each said aperture means defined in said third and fourth sides of said planar member includes a pair of spaced apertures, respectively, and wherein each said tab means includes a pair of tabs spaced predeterminedly for receipt in said respective pairs of said spaced apertures in said planar member, said tabs being bendable for securing said hanger bar brackets to said planar member.

5. A plaster frame as claimed in claim 1 wherein said ceiling includes exterior and interior surfaces and wherein said planar member is dimensioned for passage through said aperture defined in said ceiling subsequent to the removal of said hanger bar brackets therefrom for mounting said plaster frame on said interior ceiling surface.

6. A plaster frame for mounting a lighting fixture in recessed fashion in a predeterminedly dimensioned aperture defined in a ceiling, said ceiling being supported by predeterminedly spaced ceiling joists, said plaster frame including in combination: a main body portion including a planar member defined an aperture therein dimensioned similarly to said ceiling aperture; hanger bar bracket means integrally formed with said planar member along breakaway junction means defined between said planar member and said hanger bar bracket means, on a first side of said planar member, said hanger bar bracket means being adapted to receive a hanger bar for supporting said plaster frame in a first orientation between said ceiling joists, said hanger bar bracket means being detachable from said planar member at said breakaway junction means; and said hanger bar bracket means including means for reattaching said hanger bar bracket means to said planar member on a side thereon generally perpendicular to said first side, for mounting said plaster frame in a second orientation between said ceiling joists, different from said first orientation.

7. A plaster frame as claimed in claim 6 wherein said planar member is rectangular in shape and wherein said hanger bar bracket means includes first and second hanger bar brackets formed at first and second junctions defined between said planar member and said hanger bar brackets, respectively, along first and second opposite sides of said planar member, respectively, and wherein said hanger bar brackets are reattachable to said planar member along third and fourth opposite sides of said planar member for mounting said plaster frame between said ceiling joists in said second orientation.

8. A plaster frame as claimed in claim 7 wherein each said hanger bar bracket defines predeterminedly spaced, bendable tabs extending therefrom and wherein said planar member defines first and second pairs of apertures, each said pair being spaced along said third and fourth side of said planar member, respectively, a distance equal to the spacing of said tabs, for receiving said tabs thereby to reattach said hanger bar brackets to said third and fourth opposite sides, respectively, of said planar member.

9. A plaster frame as claimed in claim 8 wherein said aperture defined in said ceiling and said aperture defined in said planar member are both circular in shape, wherein said planar member defines a depending rim extending therefrom about said aperture defined therein and wherein said planar member is dimensioned for passage through said circular aperture defined in said ceiling subsequent to the removal of said hanger bar bracket means therefrom for mounting said plaster frame on said ceiling with said depending rim extending into said ceiling aperture.

* * * * *